US005775443A

United States Patent [19]

Lott

[11] Patent Number: 5,775,443

[45] Date of Patent: Jul. 7, 1998

[54] JET PUMP DRILLING APPARATUS AND METHOD

[75] Inventor: W. Gerald Lott, Houston, Tex.

[73] Assignee: Nozzle Technology, Inc., Houston, Tex.

[21] Appl. No.: 735,448

[22] Filed: Oct. 15, 1996

[51] Int. Cl.[6] ..... E21B 10/18; E21B 10/60

[52] U.S. Cl. ..... 175/57; 175/340; 175/393; 175/424

[58] Field of Search ..... 175/393, 324, 175/57, 424, 339, 340

[56] References Cited

U.S. PATENT DOCUMENTS

| | | | |
|---|---|---|---|
| 2,946,565 | 7/1960 | Williams | 175/324 |
| 3,055,442 | 9/1962 | Prince | 175/424 |
| 4,102,418 | 7/1978 | Kammerer, Jr. | 175/324 |
| 4,245,708 | 1/1981 | Cholet et al. . | |
| 4,436,166 | 3/1984 | Hayatdavoudi et al. . | |
| 4,494,618 | 1/1985 | Radtke . | |
| 4,512,420 | 4/1985 | Hayatdavoudi et al. . | |
| 5,322,222 | 6/1994 | Lott . | |
| 5,355,967 | 10/1994 | Mueller et al. . | |
| 5,417,296 | 5/1995 | Murdock . | |
| 5,462,128 | 10/1995 | Gray | 175/339 |
| 5,651,420 | 7/1997 | Tibbitts et al. | 175/393 |

FOREIGN PATENT DOCUMENTS

| | | | |
|---|---|---|---|
| 532869 | 3/1993 | European Pat. Off. | 175/393 |
| 866122 | 9/1981 | Russian Federation | 175/393 |
| 1535966 | 1/1990 | Russian Federation | 175/340 |
| 1571202 | 6/1990 | Russian Federation | 175/393 |
| 1585493 | 8/1990 | Russian Federation | 175/393 |
| 2277758 | 11/1994 | United Kingdom | 175/393 |

OTHER PUBLICATIONS

*Journal of Fluids Engineering*, "Jet Pump Cavitation With Ambient and High Temperature Water" by A.A. Kudirka and M. A. DeCoster, Mar. 1979, vol. 101, pp. 93–99.

*Journal of Fluids Engineering*, "Liquid Jet Pumps for Two-Phase Flows", by R. G. Cunningham, Jun. 1995, vol. 117, pp. 309–316.

Journal of Fluids Engineering, "A New Way to Represent Jet Pump Performance", by D.F. Elger, E.T. McLam and S. J. Taylor, Sep. 1991, vol. 113, pp. 439–444.

*Primary Examiner*—Hoang C. Dang

*Attorney, Agent, or Firm*—Bush, Riddle & Jackson

[57] ABSTRACT

A rotary drill bit (10) has a jet pump device including a plurality of jet pump assemblies (26). Each jet pump assembly (26) has an outer housing (28) secured to the bit body (14) and receiving any elongate nozzle member (46) therein in concentric relation to form an annular chamber (48) therein. A flow restriction (38) is mounted within the outer housing (28) above the nozzle member (46). The elongate nozzle member (46) has a lower nozzle port (50) and an opposed upper nozzle port (52). Drilling fluid from the central bore (20) is directed to the nozzle member (46) where the drilling fluid is divided into two streams, one stream for flow through lower nozzle port (50) against the formation and the outer stream for flow through the upper nozzle port (52) and flow restriction (38) to create a low pressure area or suction in an annular chamber (48). A low pressure cross sectional area is formed at the bottom of the bore hole (B, FIG. 4) and drilling fluid with entrained formation cuttings is drawn upwardly through the annular chamber (48) and the flow restriction (38).

30 Claims, 3 Drawing Sheets

FIG. 1
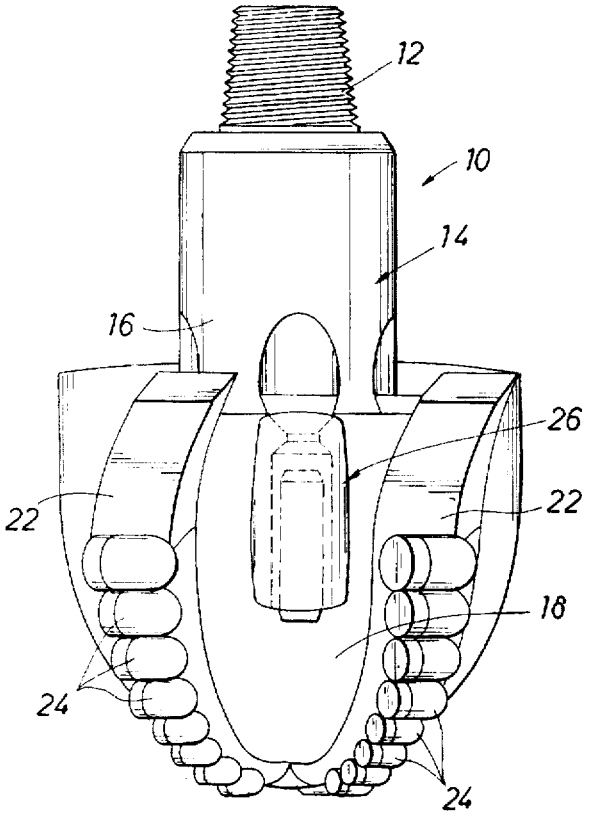
FIG. 2
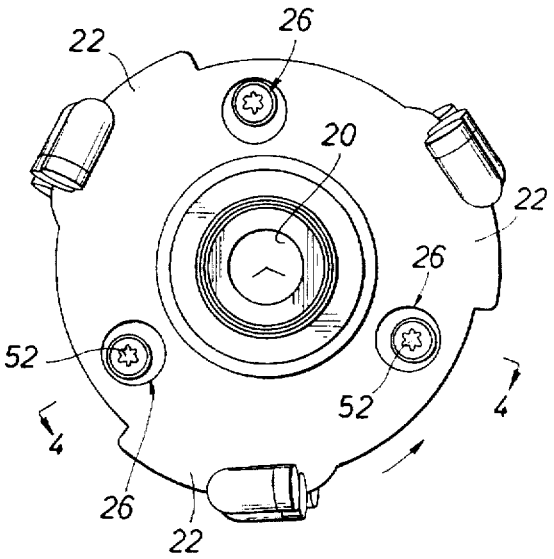
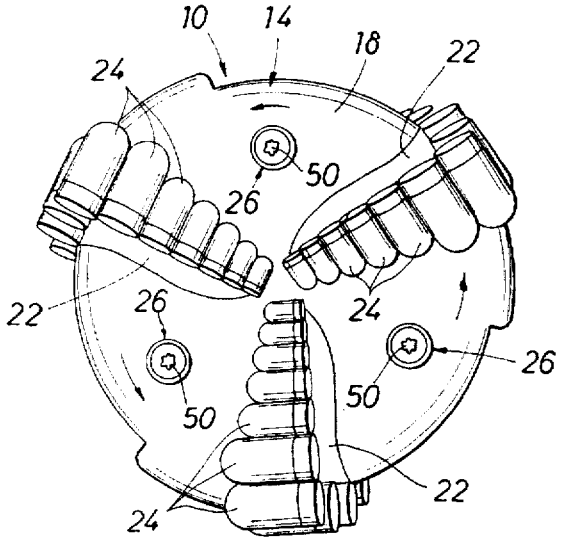
FIG. 3
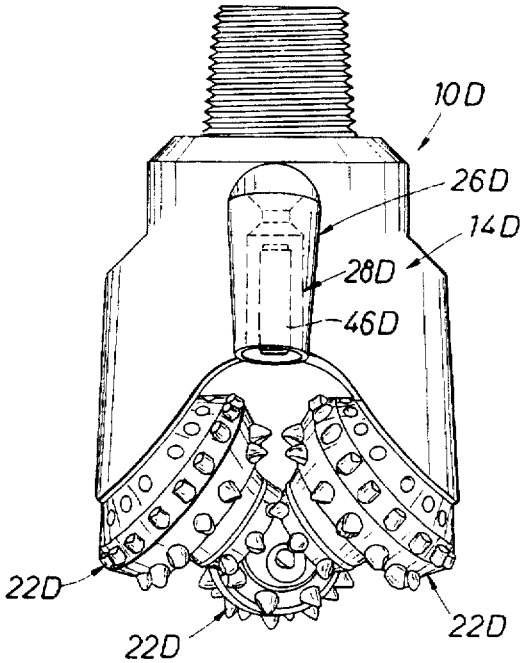
FIG. 9

FIG. 7
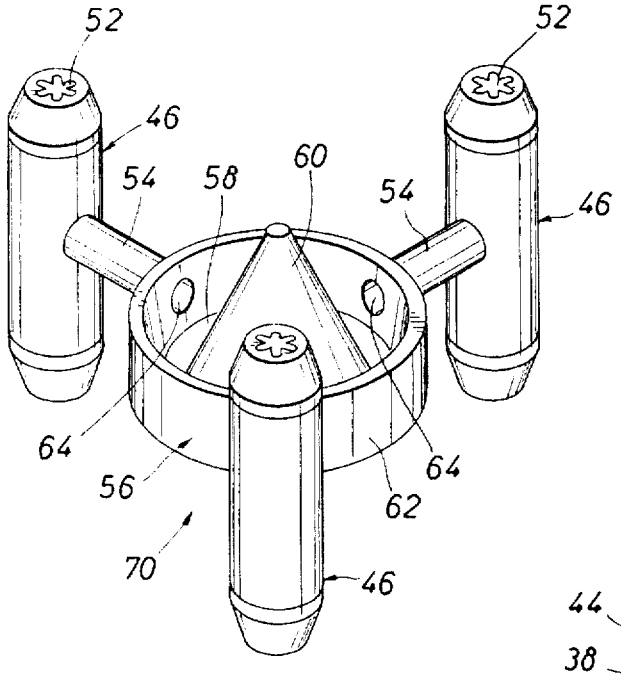
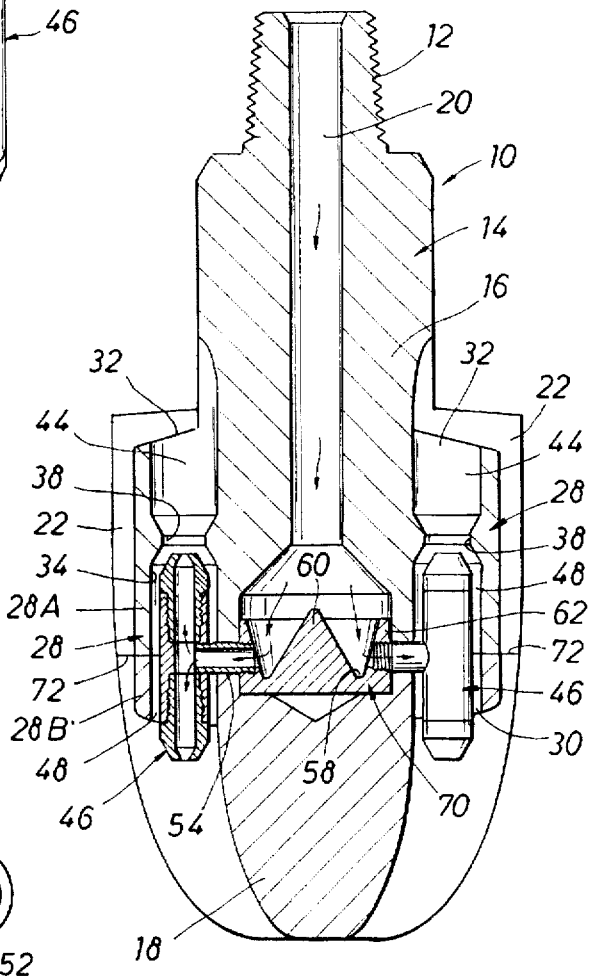
FIG. 4
FIG. 8
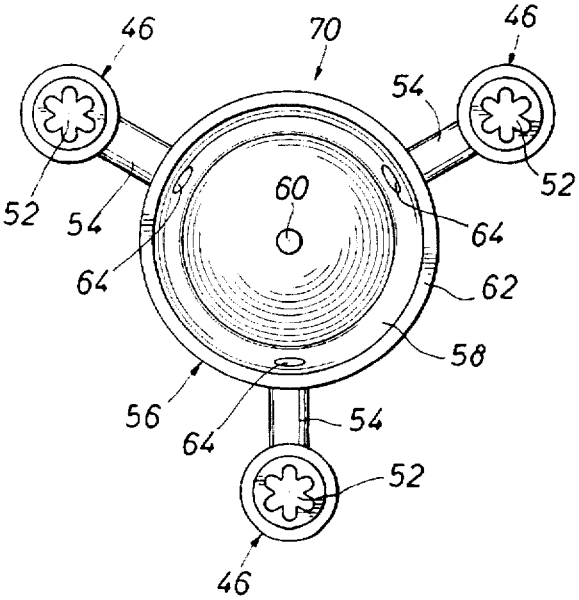

JET PUMP DRILLING APPARATUS AND METHOD

FIELD OF THE INVENTION

This invention relates to a jet pump drilling apparatus and associated method for drilling oil and gas wells, and more particularly to such an apparatus and method for a drill bit used in rotary drilling.

BACKGROUND OF THE INVENTION

Rotary drill bits are commonly used in the rotary drilling of subsurface holes such as oil and gas wells. Such rotary bits include roller cone drill bits and polycrystalline diamond compact (PDC) bits having fixed blades. In normal drilling operations under pressurized conditions, the drill string, consisting of coupled pipe sections, is the drilling fluid conduit between the drilling rig floor and the drill bit. The drill string is rotated under sufficient force to engage the drill bit "cutters" into a geological formation strata. The drill bit is the downhole terminating connection of the drill string. The drill bit body has passageways communicating with the drill string that serve as a drilling fluid distributor to route the drilling fluid flow from the drill string out through a plurality of nozzles housed in the drill bit body. The drilling fluid returns the drill cuttings to the surface through the annulus between the drill pipe and the well bore.

Drilling fluids are jetted from the bit nozzles to lubricate and dissipate the heat and cool the drill bit and downhole drilling assembly to flush drill cuttings from the borehole. Other functions of Drilling fluids is to support the walls of the drilled hole to prevent wall sloughing (caving) and prevent formation fluid intrusion into the well bore, i.e., oil, gas, or formation water.

The ability to suspend drill cuttings for fast removal from the borehole is another important and essential function of a drilling fluid. Drilling fluids are typically thixotropic fluids that have relatively high viscosities at low shear rates and low visocities at high shear rates. At relatively lower shear rates in the annulus between the well bore wall and the drill string, the viscosity increases and is sufficient to suspend the drill cuttings that are circulated upward to the surface to be mechanically separated before the drilling fluid is recirculating downhole.

A plurality of nozzles are employed in a single drill bit. In a polycrystalline diamond compact (PDC) bit, the nozzles are typically spaced in front of the leading edge of a row or sector of inserted industrial diamond or tungsten carbide nodules. In a roller cone bit, a nozzle is generally provided for each rotary cutter cone. The nozzle orientation is designed to direct the jet stream issuing from the nozzles in a downward direction toward the cutting surface of the bit to provide lubrication and keep the cutting surfaces clean, to displace the drill cuttings from the drill bit/strata contact region, and to flush the drill cuttings to the annular upstream flow of the drilling fluid.

Rapid drill cuttings displacement from the drill bit/strata contact region, keeping the bit "cutters" clean, and drill cuttings removal from the borehole are essential to maintaining a good rate of penetration (ROP). Inadequate downhole hydraulics will reduce the rate of penetration because of improper cleaning at the bit. Deficient hydraulics will ultimately cause the drill cuttings to adhere and attach to the bit body and accumulate above the "cutters" around the bit housing and drill assembly and cause "balling." "Balling" is detrimental to a drilling operation. Bit "balling" is, generally, caused from inadequate downhole hydraulics that is not sufficient to rapidly displace and remove the drill cuttings from the borehole relative to drilling rate.

Heretofore, a jet pump has been utilized with a rotary drilling tool to provide an underbalanced pressure cavity at the drilling face adjacent the formation. The drilling fluid forms the power fluid for the jet pump and cuttings are normally entrained with the drilling fluid adjacent the bottom of the formation. A flow restriction in the jet pump housing creates the underbalanced pressure at the drilling face adjacent the formation. The power driven jet pump creates suction and draws in the underbalanced mixture of drilling fluid and cuttings for the upward discharge of at least a majority of the mixture of drilling fluid and entrained cuttings at an overbalanced pressure.

U.S. Pat. No. 5,355,967 dated Oct. 18, 1994 shows particularly in FIG. 5 thereof a jet pump drilling device in which a portion of the drilling fluid is discharged downwardly against the bottom of the formation and the remaining portion of the drilling fluid creates a suction from a fluid flow restriction to draw a mixture of the drilling fluid and entrained cuttings from the bottom of the bore hole adjacent the drilling face. The overbalanced pressure upstream of the flow restriction creates a suction to direct a mixture of drilling fluid and cuttings laterally for discharge against the side of the bore hole, and then is deflected upwardly to a surface location for separation of the cuttings and drilling fluid. Thus, the drilling fluid is separated at the drilling bit into two separate streams, one stream for discharge against the formation bottom in an underbalanced relation, and the other stream for flow through a fluid flow restriction to create a suction in the space or volume adjacent the formation for directing the mixture of drilling fluid and entrained cuttings laterally against the side of the bore hole.

SUMMARY OF INVENTION

The present invention is particularly directed to a jet pump drilling apparatus and associated method for drilling oil and gas wells in which a jet pump means is combined with a drill bit to separate the drilling fluid into two separate streams at the drill bit, one stream being directed for discharge downwardly against the formation for entraining formation cuttings, and the other stream flowing upwardly through a fluid flow restriction to provide an overbalanced relation to create a suction to draw the underbalanced mixture of drilling fluid and entrained cuttings in the bore hole cavity upwardly for discharge from the well. The present invention provides (1) a low pressure loss, (2) a low friction loss, (3) increased mixing surfaces for the drilling fluid and cuttings, and (4) a relatively short mixing time for the drilling fluid and entrained cuttings.

The rotary drill bit comprising the present invention incorporates a jet pump means or device which includes a plurality of jet assemblies. The jet pump means may be utilized both with rotary drill bits having roller cones and with rotary drill bits having fixed blades with polycrystalline diamond compacts (PDC) cutting elements. A jet assembly is normally positioned adjacent each of the roller cutters or fixed blades. Each jet assembly includes an elongated jet nozzle member having a discharge nozzle at each end to define a downwardly directed nozzle and an opposed upwardly directed nozzle. The nozzle member is positioned within a generally cylindrical opening in the bit body to define an annular chamber between the nozzle member and the bit body. A flow restriction in fluid communication with the annular chamber is provided in the cylindrical opening above the nozzle member. Drilling fluid provides the power fluid for the jet pump and drilling fluid from a central bore in the drill bit body is supplied to each nozzle member where the drilling fluid is directed into two fluid streams. One fluid stream is directed downwardly to the lower nozzle port or orifice for discharge downwardly adjacent the formation at the face of the drill bit. The other stream is directed upwardly to the upper nozzle port or orifice for discharge through the flow restriction above the nozzle to provide a venturi effect. The flow restriction is in fluid communication with the annular chamber or annulus about the nozzle member and the flow of drilling fluid from the upper nozzle port through the flow restriction creates a suction or low pressure in the annular chamber which is transmitted to the bore hole bottom.

The pressurized drilling fluid from the lower discharge nozzle is discharged against the formation at the bore cavity adjacent the lower face of the drill bit and entrains formation cuttings formed by the cutting elements. The suction from the annular chamber or annulus effects a low pressure cross sectional area at the bottom of the hole and the discharged drilling fluid and entrained cuttings are drawn upwardly through the annular chamber and the flow restriction. The volume of drilling fluid discharged from the upper nozzle is substantially greater than the volume of drilling fluid discharged from the lower nozzle thereby to provide an increased underbalance at the lower face of the drill bit. Such an underbalance tends to reduce the compressive stress exerted against the hole bottom by the drill bit thereby to increase the rate of penetration. The drilling fluid and entrained cuttings passing upwardly through the flow restriction then flow upwardly to the surface in the annulus between the bore hole and drill string for separation of the cuttings from the drilling fluid.

Fluid diverter means is positioned within the central bore of the drill bit to uniformly divert the flow of drilling fluid laterally to the nozzle members. A cone shaped diverter member has an annular fluid chamber at its lower end and fluid conducts extend laterally from the annular fluid chamber to the fluid nozzle members to provide drilling fluid to the nozzle member for separating the drilling fluid into two separate fluid streams for discharge from nozzle ports on opposed ends of the nozzle member.

It is an object of this invention to provide jet pump means for a rotary drill bit that is effective to provide a low pressure area at the bottom of the hole for drawing the drilling fluid and entrained cuttings upwardly through a restricted flow restriction for flow to the surface.

A further object of the invention is to provide such a jet pump means that has a jet assembly for each of the fixed blades or roller cutters of a rotary drill bit with each jet assembly having a low pressure annulus about a downwardly directed nozzle member to provide a low pressure or suction at the bottom of the hole.

Another object of the invention is to provide such a jet assembly in which an elongate nozzle member is utilized having a nozzle port at each end thereof with a separate stream of drilling fluid being supplied to each nozzle port for discharge.

Other objects, features, and advantages of the invention will become more apparent from the following specification and drawings.

BRIEF DESCRIPTION OF THE DRAWING

FIG. 1 is a side elevation of a fixed blade rotary drill bit comprising the present invention in which a jet assembly is shown positioned between a pair of fixed blades on the bit body;

FIG. 2 is a top plan of the rotary drill bit shown in FIG. 1;

FIG. 3 is a bottom plan of the rotary drill bit shown in FIG. 1;

FIG. 4 is a section taken generally along line 4—4 of FIG. 2 and showing the jet pump comprising the present invention mounted between upper and lower body portions of the bit body;

FIG. 7 is a perspective of the jet pump device of the present invention showing a subassembly for positioning between upper and lower body portions of the drill bit;

FIG. 8 is a top plan of the subassembly jet pump device shown in FIG. 8; and

FIG. 9 in a side elevation of another embodiment in which the jet pump means comprising the present invention is mounted on a roller cutter rotary drill bit.

DESCRIPTION OF THE INVENTION

Embodiment of FIGS. 1–8

Figure 5:
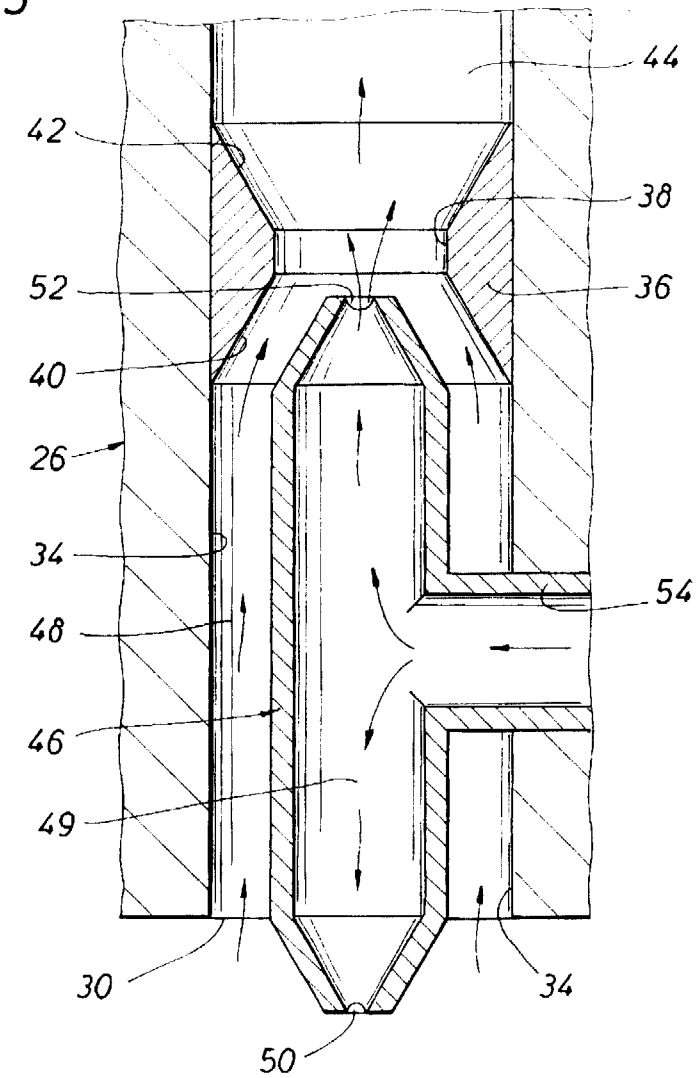
FIG. 5 is an enlarged fragment of FIG. 4 but showing the jet assembly mounted within a bore hole for directing a portion of the drilling fluid downwardly against the formation with drilling fluid and entrained cuttings being drawn upwardly through the jet pump.

The present invention is directed to a jet pump system for a rotary drill bit. Referring to the drawings for a better understanding of this invention, reference is made to the embodiment of FIGS. 1–8 in which the jet pump system is utilized with a drag-type rotary drill bit generally indicated at 10 and having an upper threaded end 12 adapted for threaded engagement with a suitable drill string or the like (not shown) extending to a surface location. Drill bit 10 has a body generally indicated at 14 having an upper body portion 16 and a lower body portion 18. The power fluid for the jet pump device of this invention comprises pressurized drilling fluid which may be pressurized liquid or a pressurized gas. A central bore 20 in body 14 supplies the pressurized drilling fluid from a surface location to drill bit body 14. A plurality of blades 22 are secured to the outer surface of bit body 14 and each blade 22 has a plurality of generally cylindrical cutting elements 24 mounted thereon with polycrystalline diamond compact (PDC) cutting faces.

A jet pump device is provided for drill bit 10 of the present invention and includes a jet assembly generally indicated at 26 positioned between each pair of adjacent blades 22. Jet assemblies 26 are substantially identical and each jet assembly 26 includes an outer generally cylindrical housing 28 on the outer surface of bit body 14 having a lower end opening 30 and an axially aligned upper end opening 32 connected by inner cylindrical surface 34. Mounted within housing 28 adjacent upper opening 32 is a fluid flow restriction, 36 forming a venturi as will be explained further. Flow restriction 36 has a restricted diameter central opening 38 with lower frusto-conical surface 40 leading to restricted opening 38 and upper frusto-conical surface 42 flaring outwardly from restricted opening 38 to form a diffusion chamber 44 about opening 38 particularly as shown in FIGS. 4 and 5.

Mounted within each housing 28 in spaced relation to inner cylindrical surface 30 is a generally cylindrical nozzle member generally designated at 46 as shown in FIG. 5. An annulus or annular chamber 48 is formed between the outer peripheral surface of nozzle member 46 and inner cylindrical surface 34. Elongate nozzle member 46 extends in an axial direction and has a central bore 49 with opposed nozzles defining lower and upper nozzle ports 50, 52. Each nozzle port 50, 52 has a generally star-shaped configuration with a circular central opening and a plurality of angularly shaped elongate outer portions about the periphery of the central opening. Upper nozzle port 52 as shown in FIG. 2 is substantially larger in cross sectional area than lower nozzle port 50 to provide an increased fluid flow through upper port 52. For further details, reference is made to my corresponding application Ser. No. 08/675,717 filed Jul. 3, 1996 and entitled "Nozzle Insert For Rotary Bit", the entire disclosure of which is incorporated by this reference.

A power fluid inlet conduit 54 extends to central bore 49 of nozzle member 46 to supply pressurized drilling fluid to nozzle member 46 from central bore 20 of drill bit 10. A fluid diverter device 56 is positioned in drill bit body 14 at the lower end of central bore 20 to divert the downward flow of pressurized drilling fluid laterally outwardly to inlet conduits 54 and nozzle members 46. The fluid diverter device 56 comprises a central cone-shaped diverter member or plug 60 positioned at the lower end of central bore 20. An outer rim 62 about diverter member 60 defines a lower annular chamber 58 about the base of diverter member 60. A port 64 at the inner end of each inlet conduit 54 is in fluid communication with annular chamber 58. Thus, pressurized drilling fluid from bore 20 is uniformly diverted by diverter member 60 laterally to inlet conduits 54 and nozzle members 46. Fluid flow from inlet conduit 54 is divided by nozzle member 46 into two streams, one stream flowing downwardly through lower nozzle port 50 and the other stream flowing upwardly through upper nozzle port 52. Upward flow through restricted opening or venturi throat 38 creates a venturi effect with the velocity of the drilling fluid increasing as the fluid passes through restricted opening 38. A low pressure area is created in annular chamber or annulus 48 by the high velocity fluid to provide a suction in annular chamber 48 which is transmitted downwardly.

Figure 6:
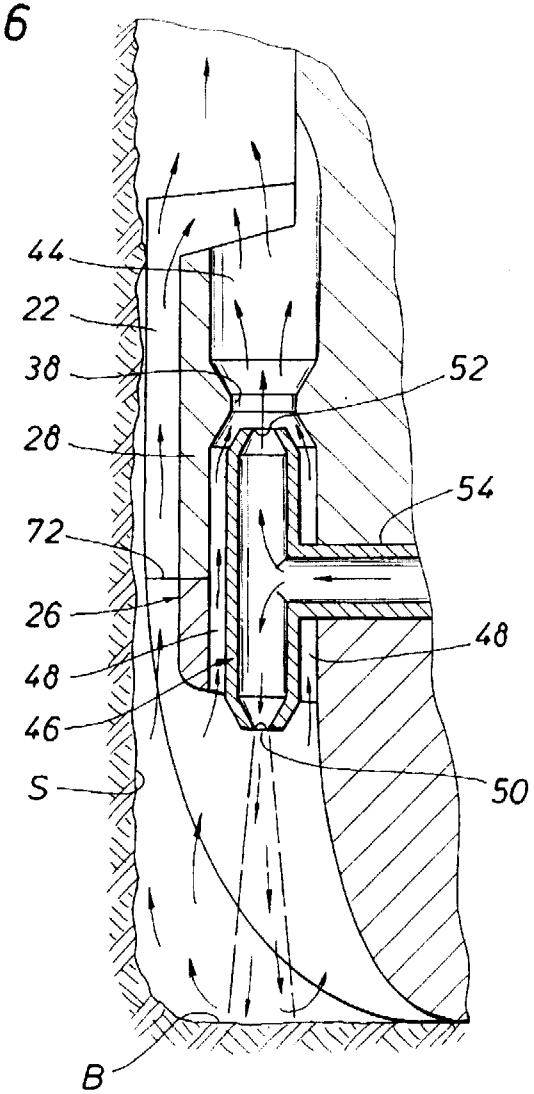
FIG. 6 is an enlarged fragment of FIG. 4 showing a jet assembly in which an elongate nozzle member is received within aligned axial openings in the upper and lower bit body portions and forms an annulus about the nozzle member to create a low pressure chamber.

Pressurized drilling fluid passing lower nozzle port 50 is diverted downwardly adjacent the formation at the bore hole bottom B shown in FIG. 6. The side of the bore hole is shown at S and a cavity is formed at the lower face or crown of drill bit 10 adjacent bore hole bottom B. The pressurized drilling fluid impacting the bore hole bottom B assists the cutting action of the rotary drill bit 10 and formation cuttings are entrained in the drilling fluid. A suction or draw is exerted by the low pressure annular chamber 48 of each jet assembly 26 and drilling fluid with entrained cuttings is drawn upwardly through annular chamber 48 and restricted opening 38 for upward flow to the surface where the drilling fluid and entrained cuttings are separated. A portion of the drilling fluid and entrained cuttings also flows upwardly alongside bit body 14 and then upwardly in the annulus between the drill string and bore hole to a surface location for mechanical separation. In order to create an adequate suction, the cross sectional area of upper nozzle port 52 should be at least about twenty (20) percent larger than the cross sectional area of lower nozzle port 50 and for best results port 52 should be about twice the cross sectional area of lower nozzle port 50 to provide a ratio of two to one. A ratio of about five to one between the cross sectional areas of nozzle ports 52 and 50 would provide satisfactory results, and in some instance a ratio as high as about ten to one would be satisfactory. The volume of the fluid flowing through ports 52 and 50 at substantially equal pressures would be proportional to the cross sectional area of ports 52 and 50. Thus, a relatively large low pressure cross-sectional area is provided at the bore hole bottom B and a relatively large suction draws the fluid and entrained cuttings from the cavity at the hole bottom B upwardly through the annulus 48 of each jet pump assembly 26.

Operation

In operation, and referring particularly to FIGS. 4∝6, pressurized drilling fluid from central bore 20 flows downwardly against diverter member 60 and is uniformly directed by diverter member 60 laterally outwardly into inlet conduits 50 and nozzle members 46. Nozzle members 46 separate the pressurized drilling fluid into a downward stream and an upward stream. The downward stream is discharged through lower nozzle port 50 against the formation and the upward stream is discharged through upper nozzle port 52 for flow through restricted opening 38 to create a suction or low pressure in annular chamber 48. The low pressure is transmitted to the bottom B of the bore hole to draw drilling fluid and entrained cuttings upwardly through annular chamber 48 and restricted opening 38 for upward flow to a surface location. Restricted opening 38 permits a mixing of the two upward flowing fluid streams which flow into the diffusion chamber 44 above restricted opening 38 for a recovery of pressure.

The jet pump of the present invention is a so-called center drive jet pump in which the power fluid is pumped through a centrally located nozzle orifice and entrains an annular suction flow. A cross sectional area of low pressure is provided at the bottom of the bore hole to reduce the overburden and increase the rate of penetration. The suction action of the jet pump is in a generally vertical upward direction is generally parallel to the downward flow of fluid from lower nozzle port 50 to provide a maximum fluid flow through the restricted opening 38. Also, any loss of kinetic energy is minimized by the general parallel flow of the fluid streams.

Fabrication of Drill Bit

Referring now particularly to FIGS. 4, 7, and 8, the fabrication of a subassembly of the jet pump device and the mounting of the subassembly into drill bit 10 are illustrated. Drill bit 10 is initially formed of two separate bit portions 16 and 18. Corresponding portions of outer housing 28 are likewise separated into upper and lower portions 28A and 28B which are separately secured to upper end lower bit portions 16A and 18A.

A jet pump subassembly generally indicated at 70 is shown in FIGS. 7 and 8 for insertion between upper and lower bit portions 16 and 18. Bit portions 16 and 18 are then secured to each other, such as by suitable welding. Subassembly 70 includes diverter device 56, inlet conduits 54 and nozzle members 46. For assembly of drill bit 10, subassembly 70 is inserted within lower body portion 18 with diverter device 56 and inlet conduits 54 supported on lower body portion 18 and nozzle members 46 received within lower end portions 28B of housings 28. Then, lower body portion 18 with subassembly 70 thereon is mounted on upper body portion 16 with nozzle members 46 received within upper housing portions 28A which are in axial adjacent with lower housing portions 28B. The upper portion of diverter device 56 and inlet conduits 54 are received within complementary recesses in upper body portion 16. Then, body portions 16 and 18 are welded together along connecting line or seam 72 as shown in FIG. 4 to secure body portions 16 and 18 to each other with subassembly 70 therebetween.

Embodiment of FIG. 9

Referring now to FIG. 9, the present jet pump apparatus comprising the present invention is shown for a roller cone drill bit generally indicated at 10D with a plurality of roller cones 22D mounted thereon for rotation. A jet pump assembly 26D similar to jet pump assembly 26 is mounted on bit body 14D between each pair of adjacent roller cutters 22D. Exterior housing 28D integral with bit body 14D receives nozzle member 46D in concentric relation. The operation of jet pump assembly 26D is similar to the operation of jet pump assembly 26.

While the jet pump apparatus of the present invention has been shown in the drawings and described in the specification as including a nozzle member having nozzles at opposed ends, it is to be understood that the upwardly directed nozzle could be positioned at a separate location from the downwardly directed nozzle and have a separate inlet conduit from the drill string to provide drilling fluid. In such a design however, the upwardly directed nozzle would be positioned adjacent the flow restriction and an annular low pressure chamber would be provided about the upwardly directed nozzle which is in fluid communication with the flow restriction. In some instances, the upwardly directed nozzle might be positioned below a flow restriction on a sub or stabilizer above the drill bit, instead of being positioned directly on the drill bit as shown. Various other modifications and adaptions will occur to those skilled in the art. However, it is to be expressly understood that such modifications and adaptations are in the spirit and scope of the present invention as set forth in the following claims.

What is claimed is:

1. A rotary drill bit for drilling a well bore hole in a formation comprising:

a bit body having a central bore to receive a pressurized drilling fluid;

a jet pump device positioned on said bit body including a jet assembly having a lower jet nozzle directed downwardly toward the formation and a fluid flow restriction;

flow diverter means communicating with said central bore to receive pressurized drilling fluid therefrom and to separate said pressurized drilling fluid into two streams for said jet assembly, one of said streams being directed to said lower jet nozzle for discharge against the formation in a downward direction and the other stream being directed through said flow restriction; and a discharge flow passage extending from a lower bore hole cavity adjacent the lower face of the drill bit through said flow restriction for said jet assembly for drawing a mixture of drilling fluid and entrained formation cuttings upwardly from said lower bore hole cavity for discharge from the well bore hole through said flow restriction.

2. A rotary drill bit as set forth in claim 1 wherein:

said jet assembly has an upper jet nozzle directed upwardly toward said flow restriction and positioned upstream of said flow restriction to direct drilling fluid through said flow restriction.

3. A rotary drill bit as set forth in claim 2 wherein:

an annular chamber is positioned about said upper jet nozzle in fluid communication with said flow restriction, the flow of drilling fluid through said restriction creating a low pressure in said annular chamber for drawing the mixture of drilling fluid and entrained formation cuttings upwardly through said flow restriction.

4. A rotary drill bit as set forth in claim 1 wherein:

an elongate nozzle member receives drilling fluid from said central bore and separates the drilling fluid into said two streams.

5. A rotary drill bit as set forth in claim 4 wherein said elongate nozzle member includes said lower jet nozzle and further has an upper jet nozzle in opposed relation to said lower jet nozzle and directed toward said flow restriction.

6. A rotary drill bit as set forth in claim 1 wherein;

said rotary drill bit has a plurality of blades fixed to said body; and a nozzle assembly is positioned adjacent each of said blades.

7. A rotary drill bit as set forth in claim 1 wherein:

said rotary drill bit has a plurality of roller cutters mounted thereon; and a nozzle assembly is positioned adjacent each of said roller cutters.

8. A rotary drill bit as set forth in claim 1 wherein:

said flow diverter means includes a tapered flow diverter member positioned within said bore hole to direct said drilling fluid in a generally lateral direction, and a lateral flow passage from said flow diverter member to said jet assembly for the supply of pressurized drilling fluid to said jet assembly.

9. A rotary drill bit as set forth in claim 8 wherein said flow diverter member is of a generally conical shape having a lower base and an annular flow channel is positioned at the base of said flow diverter member to receive the diverted drilling fluid, said lateral flow passage being in fluid communication with said annular flow channel.

10. A rotary drill bit as set forth in claim 1 wherein said jet assembly includes a nozzle member having a nozzle adjacent each end thereof, one of said opposed nozzles defining said lower jet nozzle directed downwardly toward the formation and the other of said jet nozzles being directed upwardly toward said flow restriction, said nozzle member effective to direct pressurized drilling fluid to both nozzles.

11. A rotary drilling bit as set forth in claim 10 wherein the cross sectional area of the discharge opening for said other nozzle is substantially greater than the cross sectional area of the discharge opening for said downwardly directed nozzle so that increased drilling fluid is discharged from said other jet nozzle for flow through said flow restriction.

12. Drilling apparatus for drilling a bore hole using a rotary drill bit and drilling fluid comprising:

a central bore in said drill bit for the drilling fluid;

a plurality of nozzle assemblies mounted in said drill bit adjacent said central bore, each nozzle assembly defining a jet pump including an outer housing and an inner elongate nozzle member within said outer housing forming an annular chamber therebetween, said nozzle member having a pair of nozzles facing in opposed directions, one of said nozzles facing downwardly toward the formation and the other of said nozzles facing upwardly;

a fluid passage from said central bore to said nozzle member to provide drilling fluid to said nozzles; and a fluid flow restriction positioned adjacent said upwardly facing nozzle to receive drilling fluid therefrom, said restriction being in fluid communication with said annular chamber and providing a suction in said annular chamber during flow of drilling fluid through said restriction from said upwardly facing nozzle for drawing formation cuttings and entrained drilling fluid upwardly from the bottom of the bore hole through said annular chamber and said restriction.

13. Drilling apparatus as set forth in claim 12 wherein:

said inner elongate nozzle member extends in a direction axially of said bore hole and said fluid flow restriction is mounted in said outer housing upstream of said upwardly facing nozzle.

14. Drilling apparatus as set forth in claim 12 wherein the upwardly facing nozzle has a discharge orifice therein with a cross sectional area substantially greater than the cross sectional area of a discharge orifice for the downwardly facing nozzle.

15. Drilling apparatus as set forth in claim 12 wherein:

a conically shaped plug member is mounted within said central bore adjacent said fluid passages to said nozzle assemblies to distribute drilling fluid to said passages from said central bore.

16. Drilling apparatus as set forth in claim 15 wherein said conically shaped plug member has a base and an outer annular fluid chamber about said base, said fluid passages having inlet ports in fluid communication with said annular chamber.

17. Drilling apparatus as set forth in claim 12 wherein said rotary drill bit comprises a drag-type bit having a plurality of blades with cutting elements thereon, and a nozzle assembly is provided for each blade.

18. Drilling apparatus as set forth in claim 12 wherein said rotary drill bit includes a plurality of roller cones, and a nozzle assembly is provided for each roller cone.

19. In a rotary drill bit having a body and a bore therein to receive pressurized drilling fluid for drilling a well bore in a formation; a jet assembly for said drill bit comprising:

a generally cylindrical nozzle member mounted within a generally cylindrical opening and defining an annular chamber about said nozzle member, said nozzle member having a lower jet nozzle directed downwardly toward the formation;

a flow restriction in said generally cylindrical opening above said nozzle member and in fluid communication with said annular chamber; and means to direct at least a portion of said drilling fluid from said bore to said jet nozzle for discharge against the formation adjacent the lower face of the drill bit, said means further directing a portion of said drilling fluid to said flow restriction to provide a low pressure in said annular chamber to draw drilling fluid and entrained cuttings from the bottom of the well bore adjacent the lower face of the rotary drill bit.

20. In a rotary drill bit as set forth in claim 19:

said nozzle member having an upper jet nozzle in opposed relation to said lower jet nozzle for directing a portion of said drilling fluid for flow through said flow restriction.

21. In a rotary drill bit as set forth in claim 19:

said means to direct including a diverter means adjacent said bore of said drill bit for directing said drilling fluid in a lateral direction, and a fluid passage from said diverter means to said nozzle member to provide drilling fluid to said jet nozzle.

22. In a rotary drill bit as set forth in claim 21 wherein said nozzle member is effective to direct a portion of the drilling fluid to said jet nozzle and to direct another portion of the drilling fluid to said flow restriction.

23. A nozzle assembly for a rotary drill bit comprising:

a housing having a generally cylindrical opening therethrough and a flow restriction adjacent an upper end of said housing;

a generally cylindrical nozzle member positioned within said opening below said flow restriction and having a lower nozzle directed downwardly toward a cavity in the bore hole adjacent the lower face of the drill bit, said nozzle member defining with said housing an annular chamber in fluid communication with said flow restriction with said annular chamber and flow restriction providing a discharge flow passage for drilling fluid and entrained cuttings from the bore hole cavity: and an upper nozzle for directing fluid flow upwardly through said flow restriction.

24. A nozzle assembly for a rotary drill bit as set forth in claim 23 wherein:

said nozzle member receives drilling fluid from said drill bit and divides said drilling fluid into one stream to said lower nozzle and another stream to said upper nozzle.

25. Drilling apparatus for drilling a bore hole in a formation using a rotary drill bit and pressurized drilling fluid from a drill string comprising:

a downwardly directed nozzle on said rotary drill bit for directing drilling fluid from said drill string downwardly against the bore hole formation adjacent the lower face of the rotary drill bit for entraining formation cuttings;

a fluid flow restriction for said rotary drill bit;

an upwardly directed nozzle positioned adjacent said flow restriction for directing drilling fluid from said drill string upwardly through said flow restriction; and an annular chamber formed about said upwardly directed nozzle and in fluid communication with said flow restriction to provide a low pressure area which is transmitted downwardly to draw drilling fluid and entrained cuttings upwardly through said annular chamber and said flow restriction for discharge.

26. Drilling apparatus as set forth in claim 25 wherein;

a housing having a generally cylindrical opening therein receives said upwardly directed nozzle and said flow restriction is mounted adjacent an upper end of said housing above said upwardly directed nozzle.

27. Drilling apparatus as set forth in claim 26 wherein said upwardly facing nozzle has a discharge port with a cross sectional area at least about twenty (20) percent greater than the cross sectional area of the discharge port of said downwardly directed nozzle.

28. A jet pump drilling method for drilling a bore hole in a formation utilizing a rotary drill and drilling fluid to produce formation cuttings at the lower face of the rotary drill, said jet pump drilling method comprising:

providing a jet pump on the body of the rotary drill having an elongate nozzle member, an annular chamber about the nozzle member, and a flow restriction communicating with said annular chamber;

discharging a stream of pressurized drilling fluid from the lower end of said nozzle member against the formation to provide a mixture of drilling fluid and entrained cuttings; and discharging a separate stream of drilling fluid through said flow restriction to provide a suction in said annular chamber upstream of said flow restriction thereby to draw drilling fluid and entrained cuttings upwardly for discharge from the bore hole cavity adjacent the face of said drill.

29. A jet pump drilling method as set forth in claim 28 further including the step of:

discharging said separate stream of drilling fluid in a direction opposite the direction in which said first mentioned stream of drilling fluid is discharged.

30. A jet pump drilling method as set forth in claim 29 including the steps of:

providing drilling fluid for said rotary drill through a central bore therein; and separating said drilling fluid into two streams flowing in opposed directions to each other axially of said drill.

* * * * *